US008449308B2

(12) United States Patent
Smith

(10) Patent No.: US 8,449,308 B2
(45) **Date of Patent: *May 28, 2013**

(54) ELECTRIC GROUND CLAMP WITH PIVOTED JAWS AND SINGLE ATTACHED ADJUSTING BOLT AND TERMINAL BLOCK

(75) Inventor: Lawrence J. Smith, Stamford, CT (US)

(73) Assignee: Bridgeport Fittings, Inc., Stratford, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/228,372

(22) Filed: Sep. 8, 2011

(65) Prior Publication Data

US 2012/0088380 A1 Apr. 12, 2012

Related U.S. Application Data

(63) Continuation-in-part of application No. 12/899,705, filed on Oct. 7, 2010, now Pat. No. 8,021,169.

(51) Int. Cl.
*H01R 3/06* (2010.01)

(52) U.S. Cl.
USPC ..... 439/100

(58) Field of Classification Search
USPC ..... 439/100, 802
See application file for complete search history.

(56) References Cited

U.S. PATENT DOCUMENTS

| | | | | |
|---|---|---|---|---|
| 3,892,455 | A | 7/1975 | Sotolongo | 339/14 L |
| 3,985,411 | A | 10/1976 | Mooney et al. | 339/14 L |
| D243,404 | S | 2/1977 | Mooney et al. | D13/13 |
| 4,438,958 | A | 3/1984 | DeCenzo | 285/234 |
| 5,911,585 | A | 6/1999 | Zwit | 439/100 |
| 6,840,782 | B1 | 1/2005 | Borden et al. | 439/92 |
| 6,976,857 | B1 | 12/2005 | Shukla et al. | 439/100 |
| 7,182,611 | B2 | 2/2007 | Borden et al. | 439/92 |
| 7,537,467 | B1 | 5/2009 | Gretz | 439/108 |
| 7,794,243 | B1 | 9/2010 | Rzasa et al. | 439/100 |
| 7,942,679 | B1 | 5/2011 | Gretz | 439/108 |
| 8,038,453 | B2 * | 10/2011 | Robicheau et al. | 439/100 |
| 2010/0144173 | A1 * | 6/2010 | Wason | 439/100 |

* cited by examiner

*Primary Examiner* — Gary F. Paumen
(74) *Attorney, Agent, or Firm* — Fattibene and Fattibene LLC; Paul A. Fattibene

(57) ABSTRACT

An adjustable ground clamp for easy positioning onto electric conduits of different diameters and grounding multiple electrical devices. A first and a second jaw are pivotally connected and have differently angled jaw surfaces. A distal end of the first jaw has an elongated hole and a distal end of the second jaw has a curved fork having a slot for receiving a bolt with a cylindrical nut. A fastener connects a ground conductor or wire to the ground clamp. A terminal block accepts ground conductors from multiple different electrical devices. The jaws may be easily separated for placement of an electrical conduit without separating or detaching any parts from the ground clamp, making attachment to an electrical conduit quick, easy, and secure. The terminal block permits different electrical devices to be grounded with a single ground clamp.

18 Claims, 11 Drawing Sheets

ELECTRIC GROUND CLAMP WITH PIVOTED JAWS AND SINGLE ATTACHED ADJUSTING BOLT AND TERMINAL BLOCK

RELATED APPLICATION

This application is a continuation-in-part of application Ser. No. 12/899,705 filed Oct. 7, 2010 now U.S. Pat. No. 8,021,169.

FIELD OF THE INVENTION

The present invention relates in general to an electric ground clamp for attaching to an electrical conduit, and more particularly to an adjustable clamp that is easily and quickly installed and that provides multiple grounding connections.

BACKGROUND OF THE INVENTION

In many electrical applications, it is often necessary to electrically ground a conduit. Often a ground clamp is attached to the conduit. A ground conductor or wire is then attached or connected to the ground clamp providing continuity or an electrical path to ground. Typically a compression clamp is used that often has two opposing screws or fasteners that are alternately tightened to draw two opposing sections of the clamp together substantially equally, so as to clamp down on the electrical conduit.

One such ground clamp is disclosed in U.S. Pat. No. Des. 243,404 entitled "Ground Clamp" and issuing to Mooney et al on Feb. 15, 1977. Therein disclosed is a ground clamp having opposing portions, with a screw or a fastener on each end. The ground clamp is tightened on the conduit by alternately tightening each screw on the opposing ends.

Another ground clamp is disclosed in U.S. Pat. No. 3,892,455 entitled "Ground Clamp Connector" and issuing to Sotolongo on Jul. 1, 1975. Therein disclosed is a standard ground clamp connector having a single intermediately positioned fastener for drawing two opposing body portions together. Additional nests are provided in the body portion to accept multiple ground conductors or wires.

Another ground clamp is disclosed in U.S. Pat. No. 3,985,411 entitled "Hinged Ground Clamp" and issuing to Mooney et al on Oct. 12, 1976. Therein disclosed is an electrical conduit grounding assembly and a pair of longitudinal extending dihedral angle clamp members which embrace the conduit with a hinged knuckle along a proximal longitudinal edge engaging the grounding cable. A screw on the distal end of the clamp members is used to tighten the ground clamp onto the electrical conduit.

While these prior ground clamps have been used successfully to ground electrical conduits, they are often difficult to install and often require disassembly of the ground clamp resulting in loose parts which may be lost. Additionally, often different sized conduits must be accommodated that are often in difficult to reach locations. Therefore, it may be difficult to disassemble and then reassemble a ground clamp around an electrical conduit in difficult to reach locations without loosing or dropping a part of the ground clamp. This makes installation frustrating and difficult. Therefore there is a need for a ground clamp that will accommodate a wide range of different sized conduits, and that is easy to install without the need of removing a part of the ground clamp which could be dropped or lost.

In some applications multiple electrical devices must be grounded. This often requires multiple ground clamps to be attached to a single pipe or rigid conduit. The attaching of multiple ground clamps may be difficult due to limited space. Additionally, poor electrical contact may be made when ground clamps are subsequently installed, especially if after placement of a first ground claim the pipe or rigid conduit has been painted or has become dirty or oxidized. Therefore, there is an additional need for a ground clamp that can accommodate the grounding of multiple electrical devices without removal of the ground clamp or placement of additional ground clamps.

SUMMARY OF THE INVENTION

The present invention comprises a first and a second hinged jaw with predetermined angled surfaces to securely grip a wide range of electrical conduit sizes or diameters. The first jaw has a distal end with an elongated hole holding a bolt. The second jaw has a distal end with a curved fork having a slot. The curved fork has a surface that accommodates or mates with a cylindrical nut threaded on to the bolt held by the elongated hole in the distal end of the first jaw. The slot of the curved fork receives the bolt used in securing the distal ends of the first and second hinged jaws. The predetermined angled surfaces of the hinged jaws have different angles for securely holding a wide range of different electrical conduit diameters. Means for connecting a ground conductor or wire to the ground clamp is provided on one of the first or second hinged jaws.

In another embodiment a terminal block is formed on one of the jaws of the ground clamp. The terminal block has a plurality of ground conductor connection locations. A plurality of holes is formed in the terminal block through which multiple ground conductors may be placed. A screw intersects with the hole so that the ground conductors placed therein can be securely locked or held in position.

Accordingly it is an object of the present invention to provide a ground clamp that is easily installed onto a wide range of different sized electrical conduits.

It is another object of the present invention to prevent the possible loss of a fastener or screw used with the ground clamp when attaching the ground clamp to an electrical conduit.

It is an advantage of the invention that it can be securely fastened to different electrical conduits with a range of different sizes or diameters.

It is an advantage of the invention that a single fastener, bolt, or screw is used.

It is yet another advantage of the invention that the grounding clamp can be fitted over and tightened to an electrical conduit without any disassembly resulting in loose or separated parts that could be lost.

It is a feature of the invention that an elongated hole is formed on a distal end of the first hinged jaw.

It is another feature of the invention that a curved fork having a slot is formed on the distal end of an opposing hinged jaw with the curved fork shaped to receive a cylindrical nut.

It is yet another feature of the present invention that the first and second hinged jaws have different angled surfaces adapted to accommodate the different sizes or diameters of a wide variety of electrical conduits.

It is yet another object on an embodiment of the present invention to permit multiple electrical devices to be grounded on a single ground clamp.

It is an advantage of an embodiment of the present invention that multiple grounding clamps do not have to be used for grounding multiple electrical devices.

It is a feature of an embodiment of the present invention that a terminal block is placed on a jaw of a ground clamp.

These and other objects, advantages, and features will become more readily apparent in view of the following detailed description.

DETAILED DESCRIPTION OF THE PREFERRED EMBODIMENT

Figure 1:
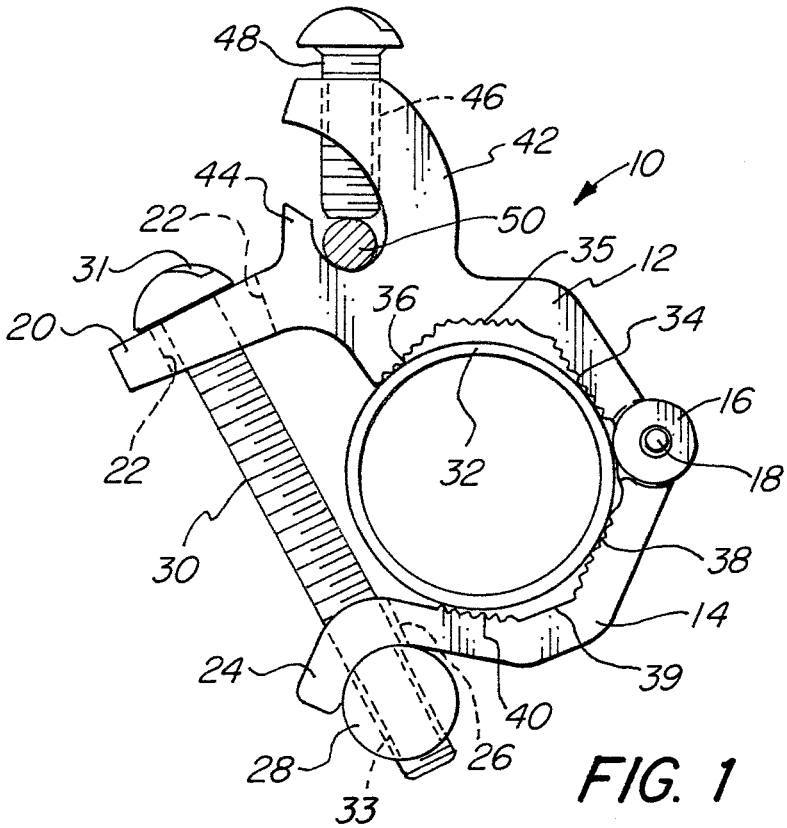
FIG. 1 is an elevational view of an embodiment of the invention holding a larger diameter electrical conduit.

FIGS. 1-7B illustrate a first embodiment of the invention. In FIG. 1 the ground clamp 10 comprises a first jaw 12 coupled to a second jaw 14 by a hinge 16 and a hinge pin 18. The first jaw 12 has a first distal end 20 having an elongated hole 22 therein. The second jaw 14 has a second distal end forming a curve having a slot 26 formed therein forming a curved fork 24. A cylindrical nut 26 has a diameter substantially matching the curve or radius of the curved fork 24 formed on to the second distal end of the second jaw 14. The cylindrical nut 28 is held on the threaded portion or end 33 of bolt 30 having a head 31. The head 31 of the bolt 30 retains the bolt 30 within the elongated hole 22. The conduit 32, which may be electrical metallic tubing or EMT or a rigid conduit, is held between the first and second jaws 12 and 14. The first jaw 12 has a first inside angled jaw surface 34 and a first outside angled jaw surface 36 separated by a first intermediate surface 35. The second jaw 14 has a second inside angled jaw surface 38 and a second outside angled jaw surface 40 separated by a second intermediate surface 39. Attached to the first jaw 12 are a stem 42 and a lip 44 forming an opening in which to drop in a ground conductor or wire 50. The stem 42 has a threaded hole 46 for receiving screw 48. The grounding clamp 10 of the invention is made of a conductive material, preferable a metal. The grounding clamp 10 may be made of extruded aluminum, die cast zinc, cast bronze, cast brass, or zinc plated steel.

Figure 2:
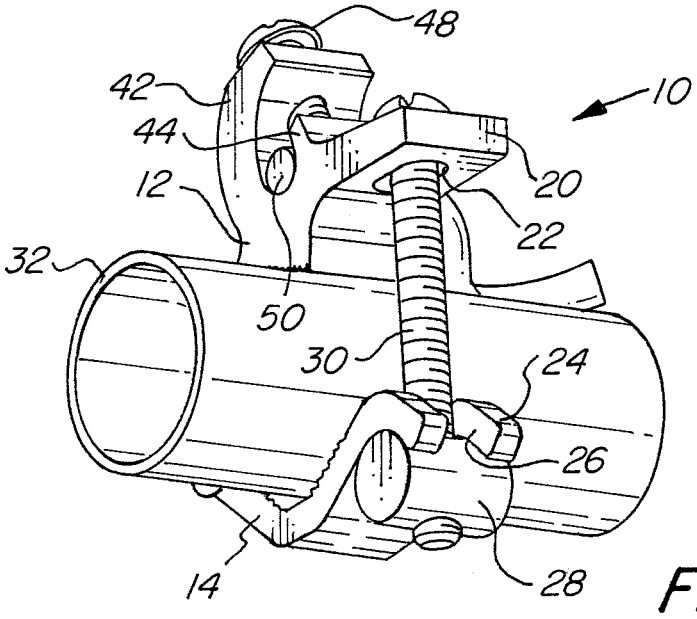
FIG. 2 is a perspective view of an embodiment of the invention holding a larger diameter electrical conduit.

FIG. 2 more clearly illustrates the cylindrical nut 28 having a diameter and the mating with the curve or radius of the curved fork 24 on the distal end of the second jaw 14. Additionally, the slot 26 forming the curved fork 24 is more clearly illustrated. The slot 26 has a width for receiving the threaded portion of the bolt 30. Also, the elongated hole on the first distal end 20 of the first jaw 12 is better illustrated.

Figure 3:
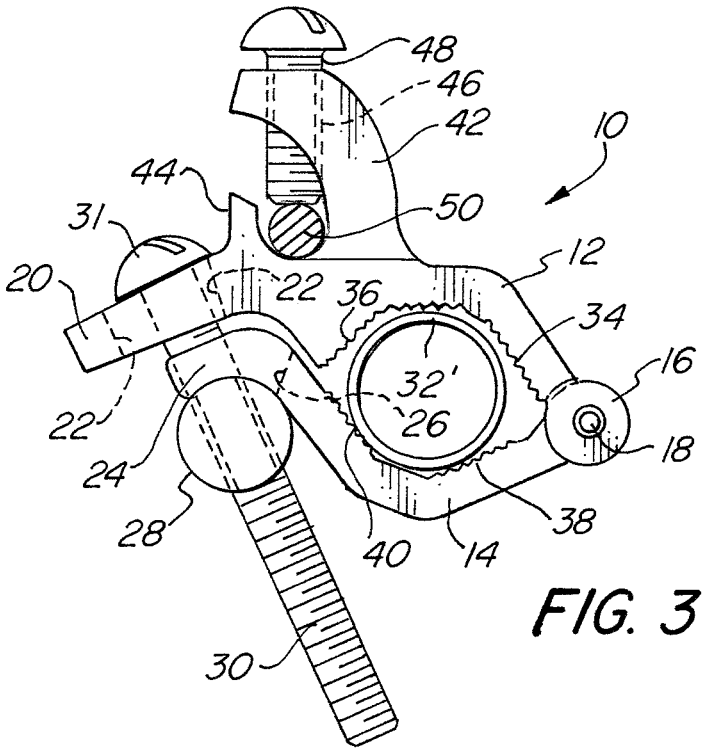
FIG. 3 is an elevational view of an embodiment of the invention holding a smaller diameter electrical conduit.
Figure 4:
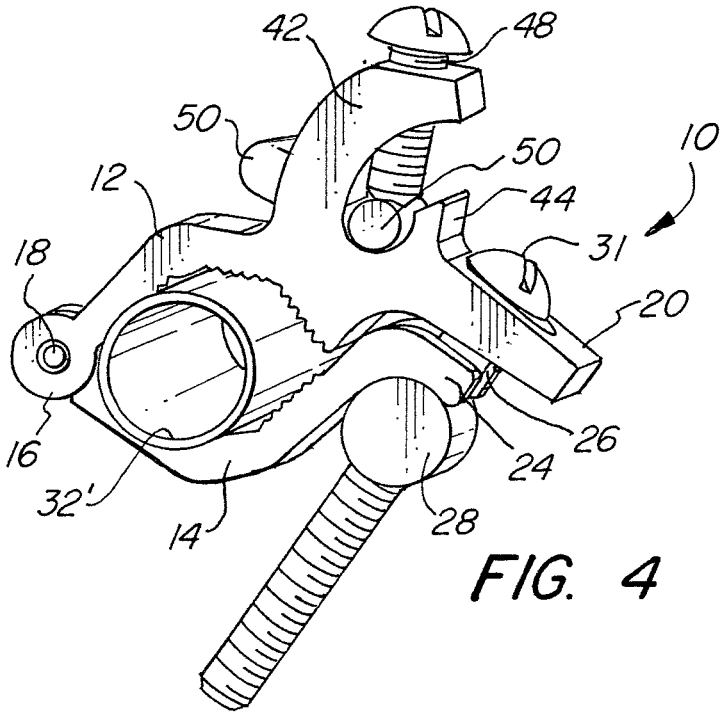
FIG. 4 is a perspective view of an embodiment of the invention holding a smaller diameter electrical conduit.

FIGS. 3 and 4 illustrate the ability of the ground clamp 10 of the invention to accommodate a wide variety or range of sizes of electrical conduits. A larger conduit 32 is illustrated in FIGS. 1 and 2, and a smaller conduit 32' is illustrated in FIGS. 3 and 4. FIGS. 3 and 4 illustrate the ground clamp 10 adjusted to hold a smaller diameter electrical conduit 32'. The different angled jaw surfaces 34, 36, 38, and 40 in combination with the intermediate surfaces 35 and 39 securely hold different size electrical conduits 32, illustrated in FIGS. 1 and 2, or 32' illustrated in FIGS. 3 and 4.

Figure 5:
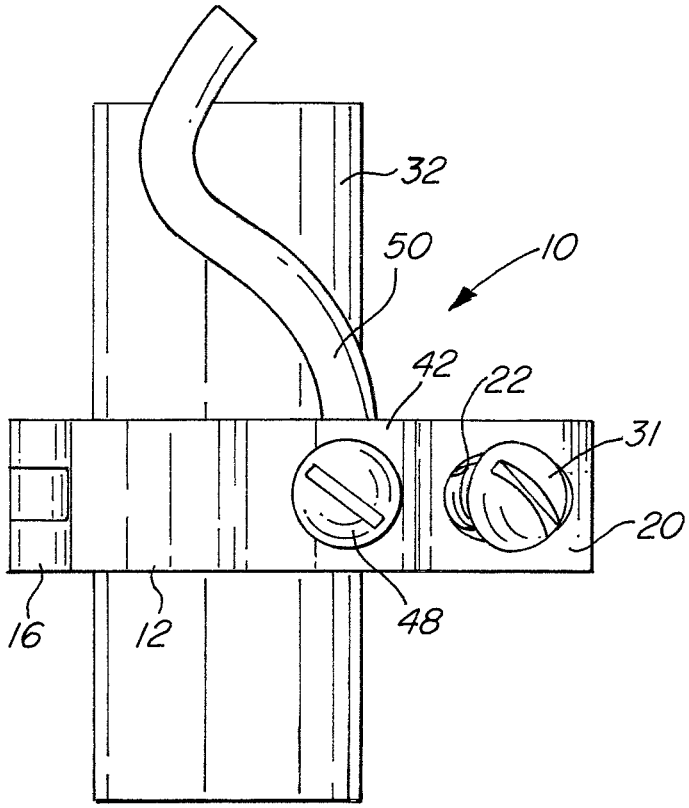
FIG. 5 is a plan view of an embodiment of the invention.

FIG. 5 is a plan view more clearly illustrating the electrical conduit 32 held within the first jaw 12 of the ground clamp 10. The ground conduit or wire 50 is also more clearly illustrated being held by stem 42 and screw 48.

Figure 6:
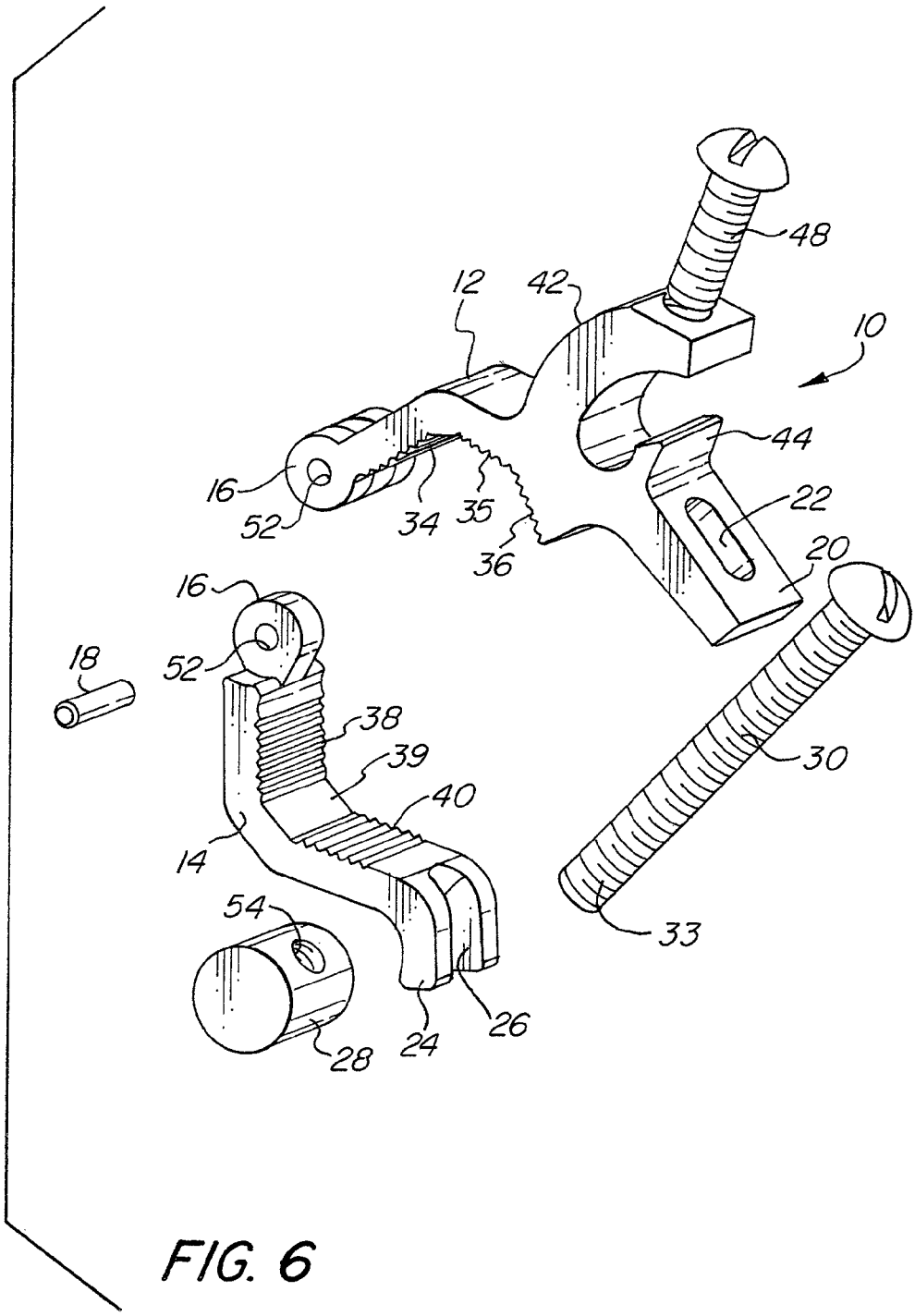
FIG. 6 is an exploded view of an embodiment of the invention.

FIG. 6 is an exploded view of the embodiment of the invention illustrated in FIGS. 1-5. FIG. 6 more clearly illustrates the parts and assembly of the invention. The hinge 16 and the hinge pin hole 52 as well as the hinge pin 18 are more clearly illustrated. Additionally the cylindrical nut hole 54 that receives the threaded portion or end 33 of the bolt 30 is more clearly illustrated.

Figure 7A:
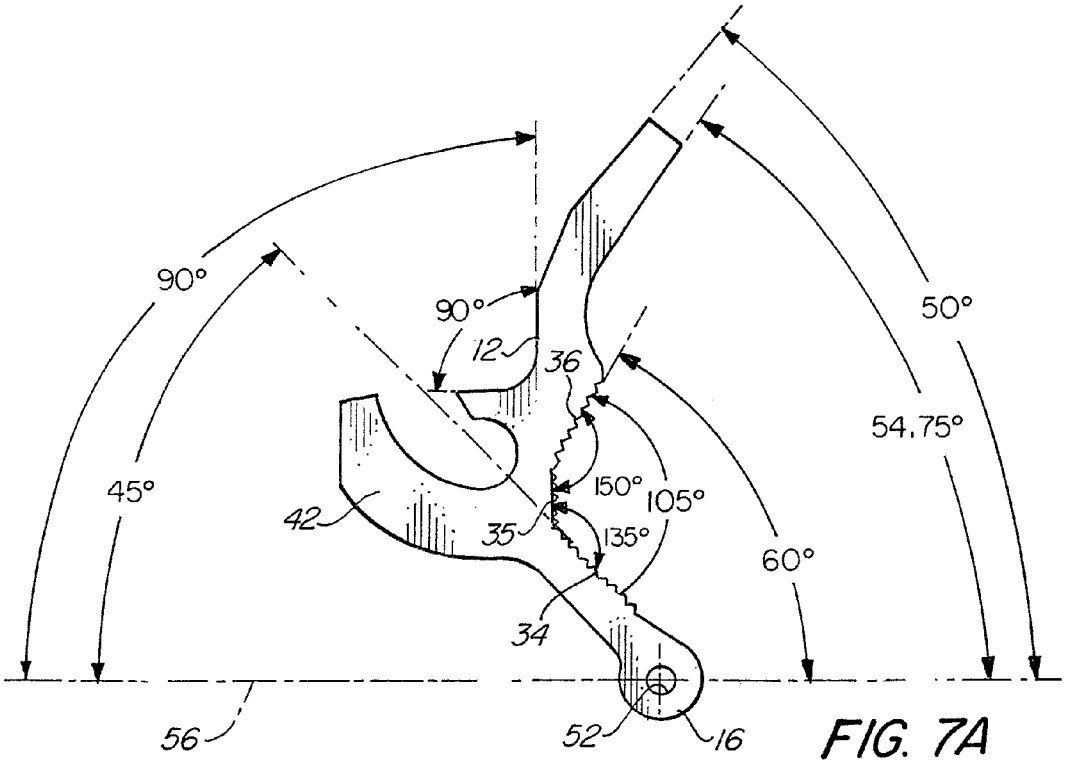
FIG. 7A schematically illustrates the angled surfaces of a first jaw of an embodiment of the invention.

FIG. 7A more clearly illustrates the angled jaw surfaces of the first jaw 12. The first inside angled jaw surface 34 is positioned in a plane that is substantially 45° from a horizontal reference line 56. The first outside angled jaw surface 36 is positioned in a plane that is substantially 60° from a horizontal reference line 56. The first intermediate surface 35 between the first inside angled jaw surface 34 and the first outside angled jaw surface 36 is in a plane substantially perpendicular to the horizontal reference line 56. The angle between the first inside angled jaw surface 34 and the first outside angled jaw surface 36 is therefore preferably substantially 105°. Additionally, the angle between the first inside angled jaw surface 34 and the first intermediate surface 35 is preferably substantially 135° and the angle between the first outside angled jaw surface 36 and the first intermediate surface 35 is preferably substantially 150°.

Figure 7B:
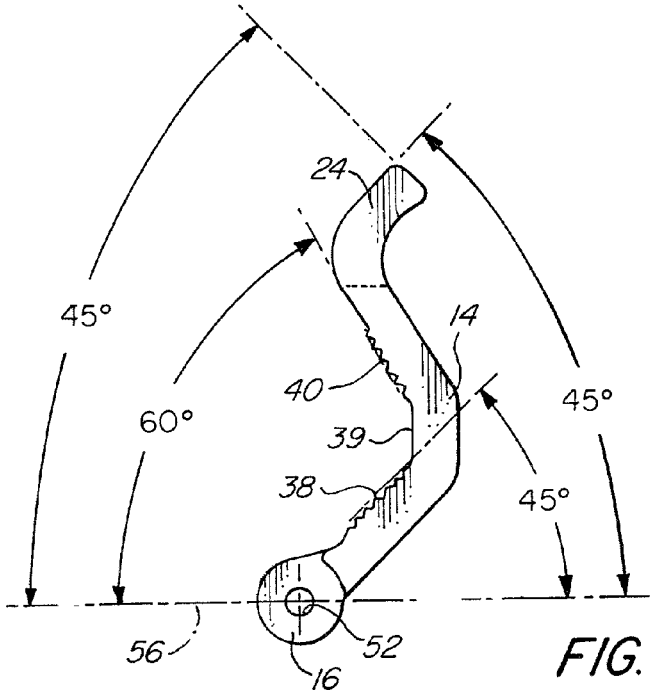
FIG. 7B schematically illustrates the angled surfaces of a second jaw of an embodiment of the invention.

FIG. 7B schematically illustrates the angular relationship of the second inside angled jaw surface 38 and second outside angled jaw surface 40 of the second jaw 14. The second inside angled jaw surface 38 is positioned in a plane that is preferably substantially 45° from a horizontal reference line 56. The second outside angled jaw surface 40 is positioned in a plane that is preferably substantially 60° from a horizontal reference line 56. The second intermediate surface 39 between the second inside angled jaw surface 38 and the second outside angled jaw surface 40 is in a plane preferably substantially perpendicular to the horizontal reference line 56. The angle between the second inside angled jaw surface 38 and the second outside angled jaw surface 40 is therefore preferably substantially 105°. Additionally, the angle between the second inside angled jaw surface 38 and the second intermediate surface 39 is preferably substantially 135° and the angle between the second outside angled jaw surface 40 and the second intermediate surface 35 is preferably substantially 150°.

Accordingly, in both the first and second jaws 12 and 14 the first and second inside angled jaw surfaces 34 and 38 are positioned at a different angle relative to a horizontal reference line 56 than the first and second outside angled jaw surfaces 36 and 40. These different relative angles permit the first and the second jaws 12 and 14 to securely grip a wide range of different size or diameter electrical conduits. These angular relationships of the jaw surfaces 34, 35, 36, 38, 39, and 40 of the first and second jaws 12 and 14 allows the ground clamp to be attached to different electrical conduit having a range of sizes. In a preferred embodiment the difference in angles accommodates different electrical conduit ranging from approximately 0.700 to 1.32 inches or 1.78 to 3.35 cm in diameter. Therefore the ground clamp can securely hold a standard electrical metallic tube from one-half to one inch and a standard rigid conduit from one-half to one inch. However, it should be appreciated that the ground clamp of the invention may be rescaled to securely hold different sized conduits within a broad range.

Figure 8:
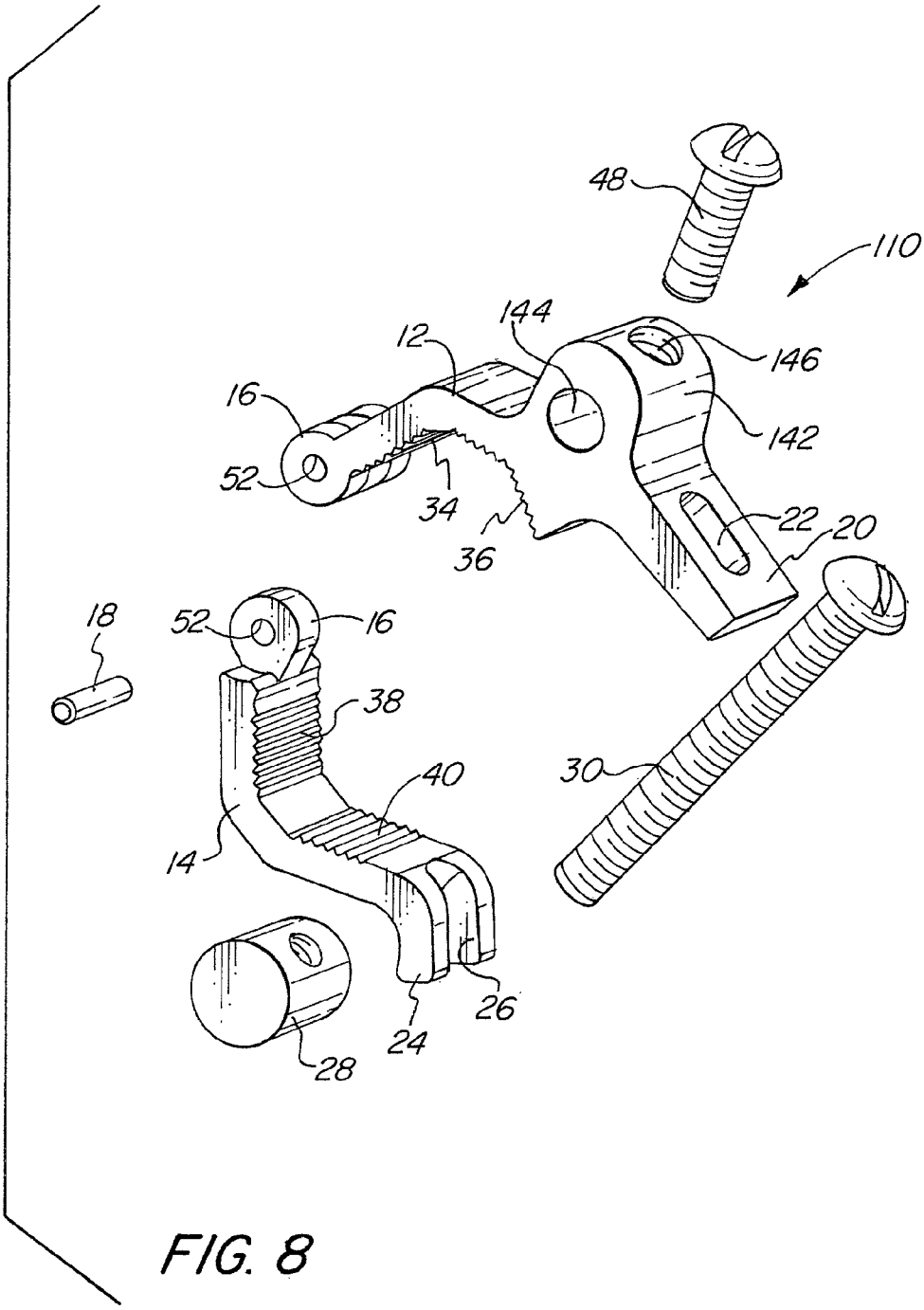
FIG. 8 is an exploded view of another embodiment of the invention utilizing a lug mount for attaching a ground conductor or a wire.

FIG. 8 is an exploded view of another embodiment of the invention. In this embodiment, a different means for attaching a ground conductor is illustrated. The ground clamp 110 has a lug or mound 142 having a ground conductor through hole 144. Placed within the lug or mound 142 is a threaded hole 146 for receiving the screw 48. A ground conductor or a wire, not shown, placed within the ground conductor or wire through hole 144 is securely held in place by tightening screw 48 down thereon.

Figure 9:
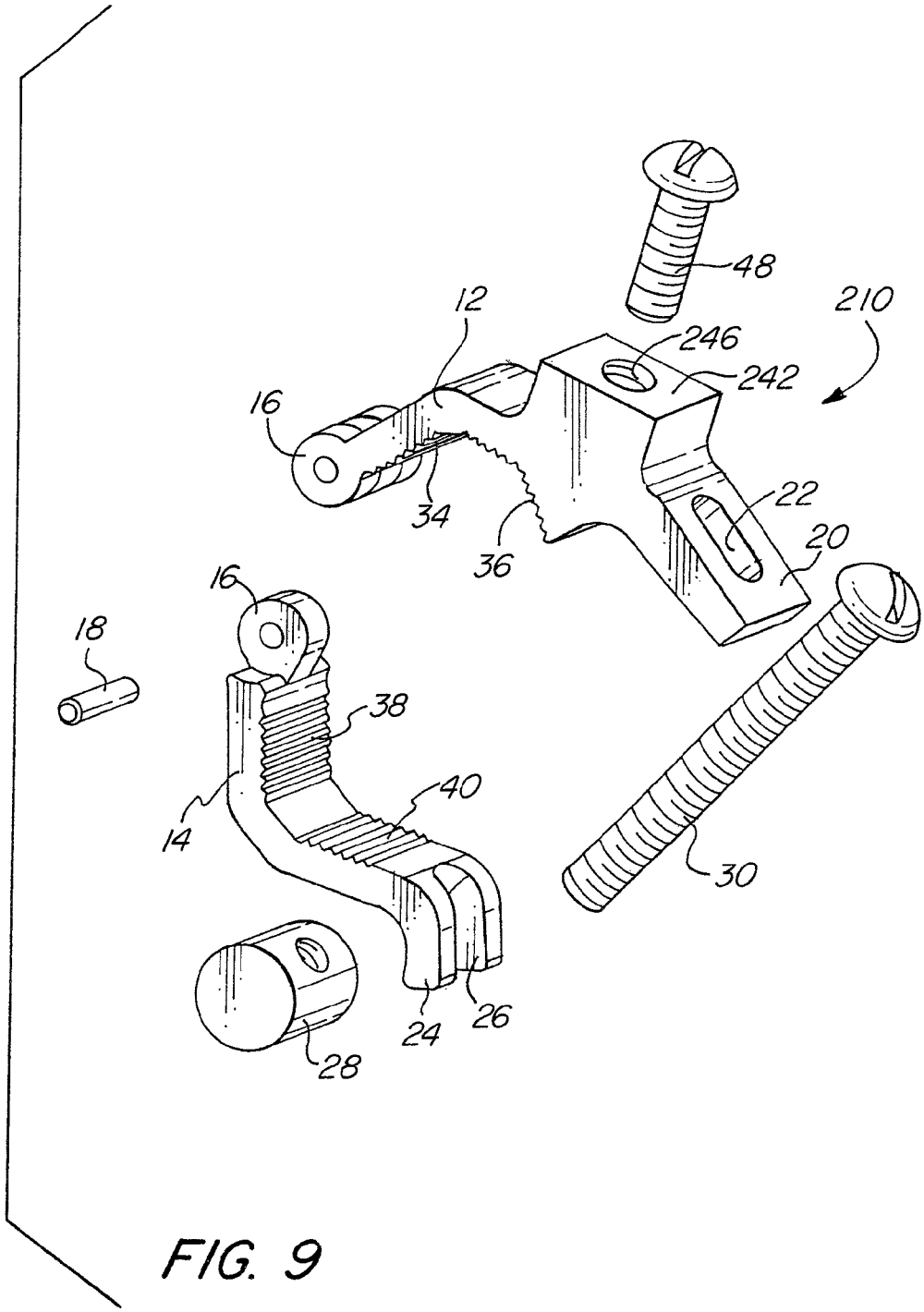
FIG. 9 is an exploded view of another embodiment of the invention utilizing a pad mount for attaching a ground conductor or a wire.
Figure 10:
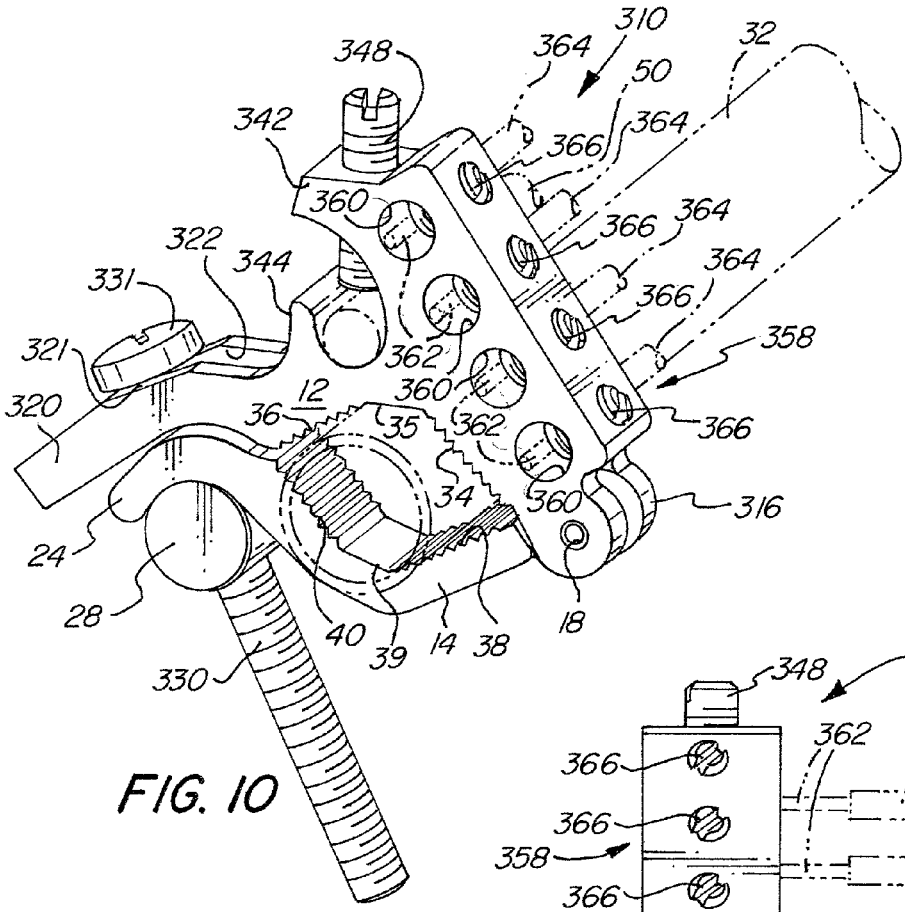
FIG. 10 is a perspective view of an embodiment of the invention having a terminal block.
Figure 11:
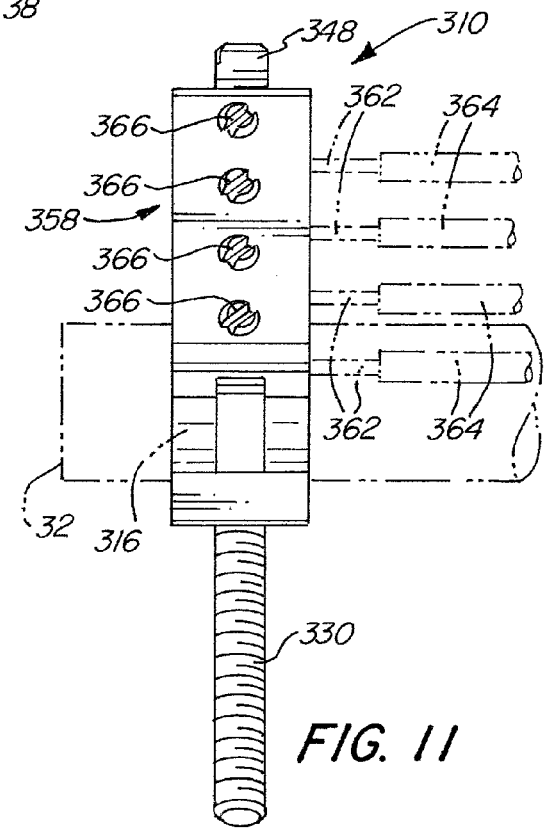
FIG. 11 is a front elevational view of the embodiment illustrated in FIG. 10.
Figure 12:
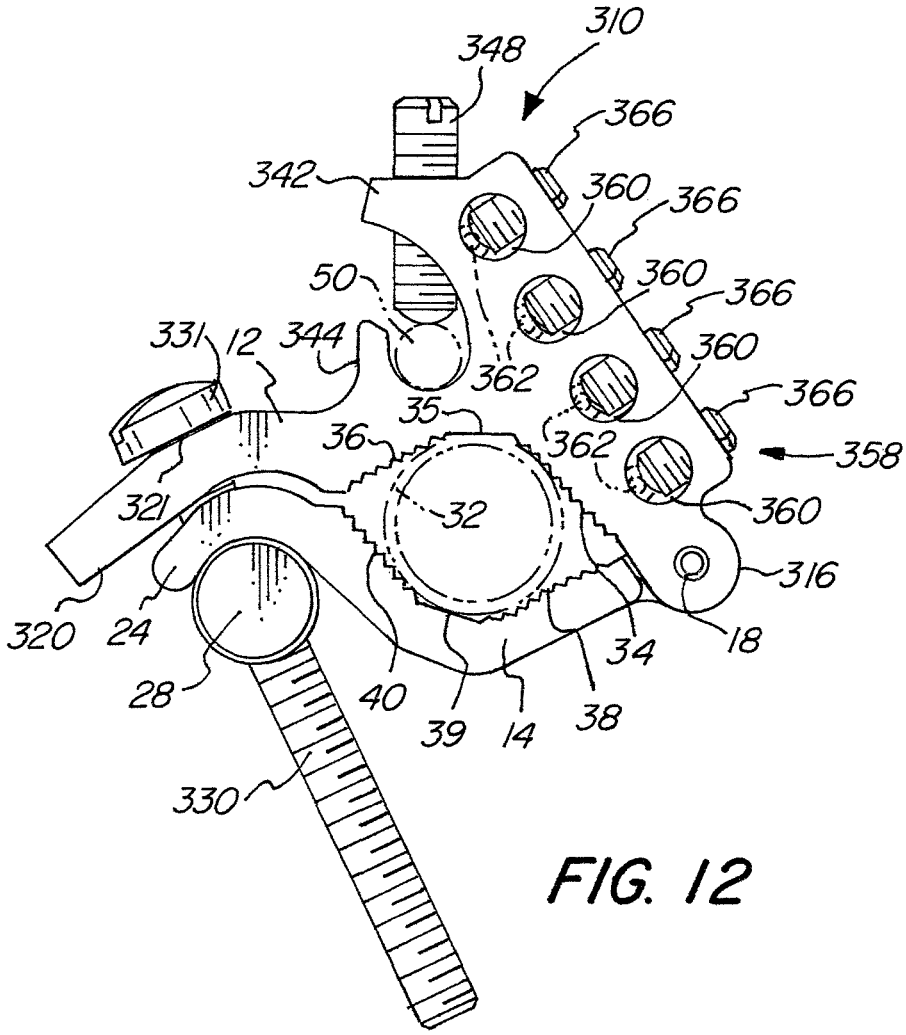
FIG. 12 is a side elevational view of the embodiment illustrated in FIG. 10.
Figure 13:
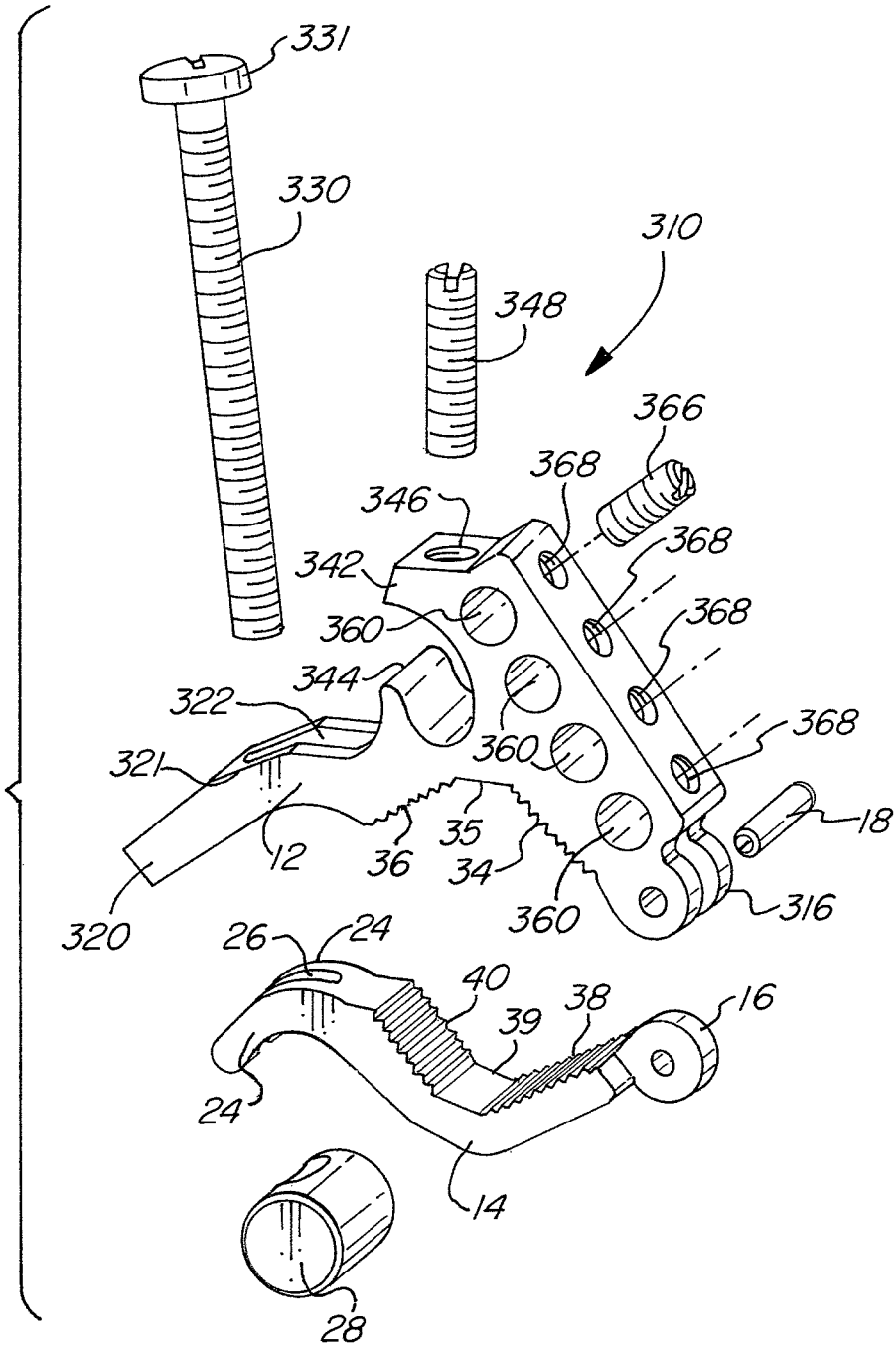
FIG. 13 is an exploded view of the embodiment illustrated in FIG. 10.

FIG. 9 is an exploded view of another embodiment of the invention. The ground clamp 210 in this embodiment has a pad 242 having a threaded hole 246 therein. The screw 48 threads within the threaded hole 246. Therefore, a ground conductor or wire, not shown, wrapped around or placed under screw 48 may be securely held by tightening screw 48 within the threaded hole 246 and securing the ground conductor or wire adjacent the pad 242.

As illustrated in the figures and in particular in FIGS. 1 to 4, the ground clamp 10 can easily be adjusted to accommodate electrical conduits 32 and 32' of substantially different diameters. Additionally, the ground clamp 10 can easily be adjusted without disassembling or separating any parts of the ground clamp which may be lost or dropped during attachment to an electrical conduit. The combination of the cylindrical nut 28 and the slot 26 in the curved fork 24 permits the second jaw 14 to pivot downward, providing a substantial and large space between the first and second jaws 12 and 14. After insertion of the electrical conduit 32 or 32' head 31 may be turned causing the cylindrical nut 28 placed adjacent the curved fork 24 to draw the first and second jaws together so that the angled jaw surfaces 34, 36, 38 and 40 securely hold the electrical conduit 32 or 32'. The elongated hole 22 formed in the first distal end of the first jaw 12 permits some movement of the bold 30 maintaining alignment when different size electrical conduits are held. The cylindrical nut 28 and curved fork 24 permits the bolt 30 to pivot so as to accommodate and securely hold a wide range of different sized electrical conduits.

The present invention, by providing a unique combination of angled jaw surfaces 34, 36, 38 and 40 in combination with the bolt 30 having a cylindrical nut 28 and curved fork 24 provides an improved electric ground clamp that can securely hold different sized or diameters of electrical conduits and that can be assembled quickly and easily without disassembly of any portion of the ground clamp. The electric ground clamp can easily be placed in hard to reach locations without difficult manipulation.

FIGS. 10-13 illustrate another embodiment of the invention. In this embodiment a terminal block 358 is formed on the first jaw 12 of the ground clamp 310. In this embodiment the terminal block 358 permits multiple electrical devices to be grounded on a single ground clamp 310. The ground clamp 310 comprises a first jaw 12 and a second jaw 14 connected by a hinge 16 and hinge pin 18. The first jaw 12 has a first distal end 320 with an elongated hole 322 therein and a flat portion 321. The first jaw 12 has a first inside angled jaw surface 34, first intermediate surface 35, and first outside angled surface 36. The second jaw 14 has second distal end with a curved fork 24, a second inside angled jaw surface 38, second intermediate surface 39, and second outside angled surface 40. The first and second jaws 12 and 14 are drawn together by bolt 330 having head 331 and cylindrical nut 28. The first jaw 12 has an opening formed by lip 344 and stem 342. Screw 348 is used to hold ground conductor or wire 50 securely therein. When closed the first and second jaws 12 and 14 securely hold pipe or rigid conduit 32 therein.

The ground clamp 310 has terminal block 358 formed thereon. The terminal block 358 has a plurality of holes 360 therein. The holes 360 are adapted to receive conductors 362 from ground wires 364. The ground wires 364 are coupled to other electrical devices that may need to be grounded, such as phone, data, or cable TV. Screws 366 are placed within threaded holes 368, illustrated in FIG. 13, to securely hold the conductors 362. Therefore, a plurality of electrical devices, not illustrated, may be grounded with a single ground clamp 310. While four holes 360 for receiving conductors 362 have been illustrated any number of holes 360 may be used.

Figure 14:
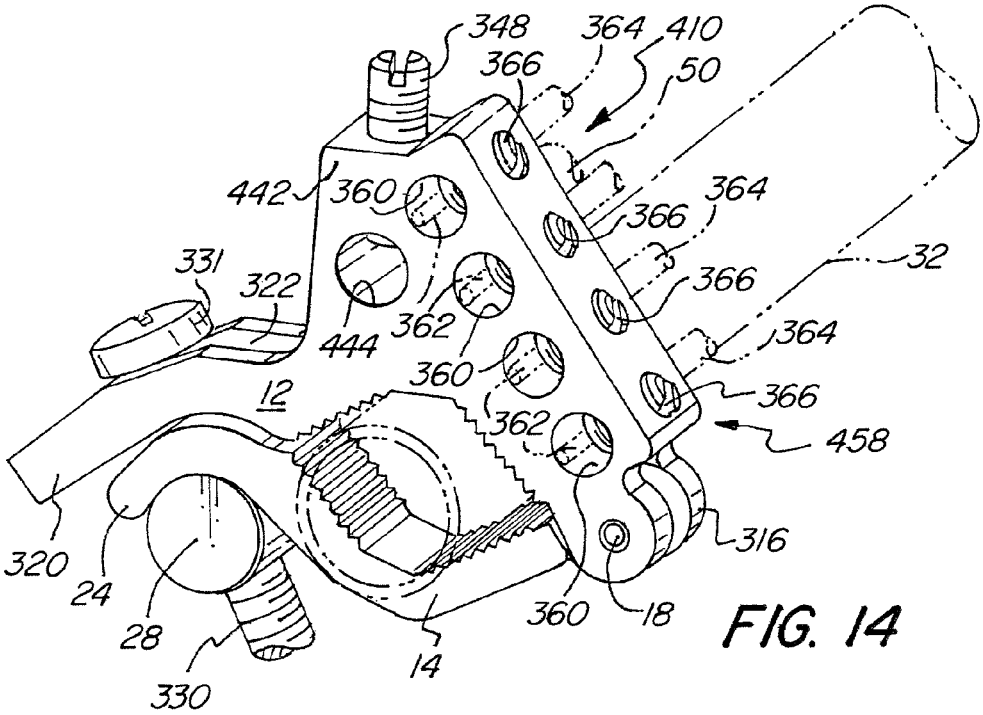
FIG. 14 is a perspective view of another embodiment of the invention having a terminal block.

FIG. 14 illustrates another embodiment of a ground clamp. This embodiment is similar to the embodiment illustrated in FIGS. 10-13, however in this embodiment a different means for attaching ground conductor 50 is illustrated. The ground clamp 410 has a mound 442 formed within the first jaw 12 and terminal block 458. A hole 444 is placed in the mound 442 for receiving the ground conductor 50. Screw 348 is threaded into a threaded hole intersecting with the hole 444 so as to contact the ground conductor 50 placed therein and securely hold it in position.

Figure 15:
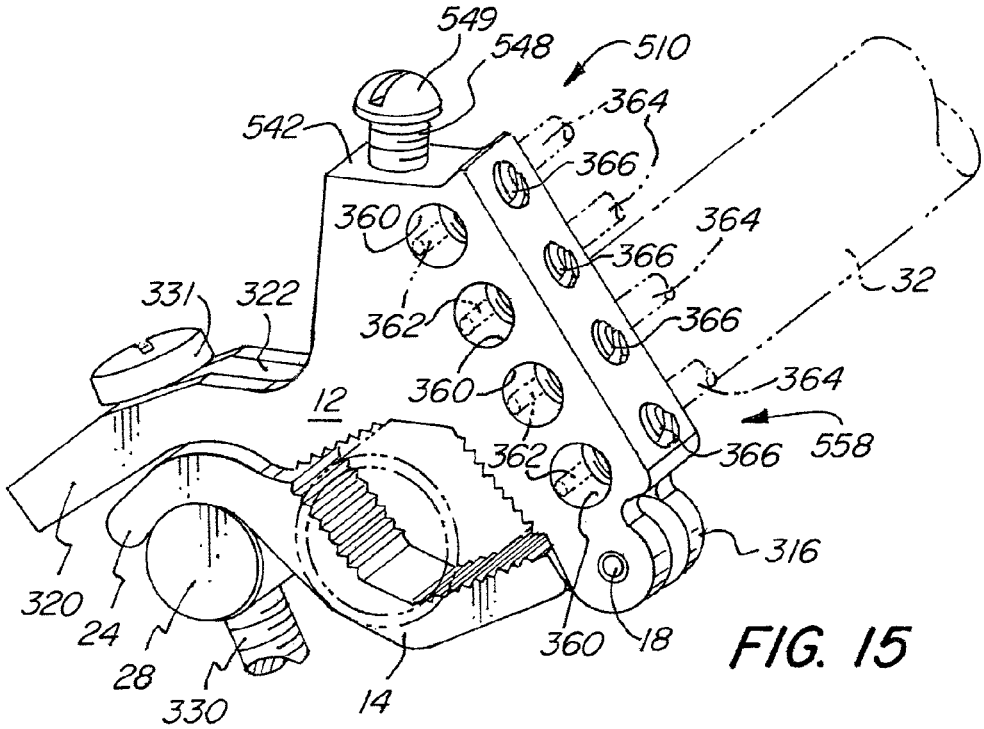
FIG. 15 is a perspective view of yet another embodiment of the invention having a terminal block.

FIG. 15 illustrates yet another embodiment of a ground clamp. This embodiment is similar to the embodiment illustrated in FIGS. 10-13, however in this embodiment another different means for attaching a ground conductor is illustrated. The ground clamp 510 in this embodiment has a pad 542 having a threaded hole with screw 548 threaded therein. Therefore, a ground conductor or wire, not shown, wrapped around or placed under screw head 549 may be securely held by tightening screw 548 within the threaded hole and securing the ground conductor or wire adjacent the pad 542.

As illustrated in FIGS. 10-15, the ground clamps illustrated therein provide the additional advantage of having a terminal block formed thereon for attaching or retaining a ground conductor for a multiple number or plurality of electrical devices. The plurality of retainers permits additional electrical devices to be grounded without disrupting or removing the ground clamp. This saves considerable time when connecting additional electrical devices and provides a more reliable ground connection.

While the present invention has been described with respect to several different embodiments, it will be obvious that various modifications may be made without departing from the spirit and scope of this invention.

What is claimed is:

1. An adjustable ground clamp that adjusts to different sizes of electrical conduits comprising:

a first jaw having angled jaw surfaces;

a second jaw having angled jaw surfaces;

a hinge connecting said first and second jaws together;

a first distal end of said first jaw having an elongated hole therein;

a curved fork formed on a second distal end of said second jaw, said curved fork having a slot therein;

a bolt having a head placed through the elongated hole in said first distal end of said first jaw;

a cylindrical nut placed on a threaded end of said bolt and mating with said curved fork;

a ground conductor retainer formed on the adjustable ground clamp; and a terminal block having a plurality of conductor retainers formed on said terminal block, whereby said bolt and said cylindrical nut may be removed from said curved fork and said first and second jaws pivoted open for receiving the electrical conduit and said bolt repositioned within the slot with said cylindrical nut held by said curved fork securely retaining the electrical conduit and a plurality of conductors may be held in the plurality of retainers permitting a multiple number of electrical devices to be grounded.

2. An adjustable ground clamp that adjusts to different sizes of electrical conduits as in claim 1 wherein:

the angled jaw surfaces of each of said first and second jaws have different angles relative to a horizontal reference line passing through said hinge.

3. An adjustable ground clamp that adjusts to different sizes of electrical conduits as in claim 2 wherein:

the different angles relative to a horizontal reference line comprise 45° and 60°.

4. An adjustable ground clamp that adjusts to different sizes of electrical conduits as in claim 1 wherein:

the angled jaw surfaces of each of said first and second jaws are separated by 105° degrees.

5. An adjustable ground clamp that adjusts to different sizes of electrical conduits as in claim 1 wherein:

said ground conductor retainer comprises a stem placed on said first jaw, a lip placed on said first jaw adjacent the stem, and a screw extending through the stem, whereby a ground conductor may be positioned adjacent the stem and securely held by the lip and the screw.

6. An adjustable ground clamp that adjusts to different sizes of electrical conduits as in claim 1 wherein:

said ground conductor retainer comprises a lug having a through hole, a threaded hole, and a screw placed in the threaded hole.

7. An adjustable ground clamp that adjusts to different sizes of electrical conduits as in claim 1 wherein:

said ground conductor retainer comprises a pad, a threaded hole in the pad, and a screw placed within the threaded hole.

8. An adjustable ground clamp that adjusts to different sizes of electrical conduits as in claim 1 wherein:

the plurality of conductor retainers comprises a plurality of holes and a plurality of screws, wherein one each of said plurality of screws intersects with one each of said plurality of holes, whereby a conductor is securely held in each of said plurality of holes.

9. An adjustable ground clamp that adjusts to different sizes of electrical conduits as in claim 1 wherein:

said terminal block is formed on said first jaw.

10. An adjustable ground clamp that adjusts to different sizes of electrical conduits without detachment of any parts comprising:

a first jaw having a first at least two angled jaw surfaces with different angles relative to a first intermediate surface between each of the first at least two angled jaw surfaces;

a second jaw having a second at least two angled jaw surfaces with different angles relative to a second intermediate surface between each of the second at least two angled jaw surfaces;

a hinge connecting said first and second jaws together;

a first distal end of said first jaw having an elongated hole therein;

a curved fork formed on a second distal end of said second jaw, said curved fork having a slot therein;

a bolt having a head placed through the elongated hole in said first distal end of said first jaw;

a cylindrical nut having a diameter placed on a threaded end of said bolt, the diameter of said cylindrical nut mating with a radius of said curved fork;

a ground conductor retainer formed on the adjustable ground clamp; and a terminal block having a plurality of conductor retainers formed on said terminal block, whereby said bolt and said cylindrical nut may be removed from said curved fork and said first and second jaws pivoted open for receiving the electrical conduit and the bolt repositioned within the slot with said cylindrical nut held by said curved fork securely retaining the electrical conduit and a plurality of conductors may be held in the plurality of retainers permitting a multiple number of electrical devices to be grounded.

11. An adjustable ground clamp that adjusts to different sizes of electrical conduits without detachment of any parts as in claim 10 wherein:

the different angles relative to the first and second intermediate surfaces and the first and second at least two angled jaw surfaces comprise 150° and 135°.

12. An adjustable ground clamp that adjusts to different sizes of electrical conduits without detachment of any parts as in claim 10 wherein:

said ground conductor retainer comprises a stem placed on said first jaw, a lip placed on said first jaw adjacent the stem, and a screw extending through the stem, whereby a ground conductor may be positioned adjacent the stem and securely held by the lip and the screw.

13. An adjustable ground clamp that adjusts to different sizes of electrical conduits without detachment of any parts as in claim 10 wherein:

said ground conductor retainer comprises a lug having a through hole, a threaded hole, and a screw placed in the threaded hole.

14. An adjustable ground clamp that adjusts to different sizes of electrical conduits without detachment of any parts as in claim 10 wherein:

said ground conductor retainer comprises a pad, a threaded hole in the pad, and a screw placed within the threaded hole.

15. An adjustable ground clamp that adjusts to different sizes of electrical conduits as in claim 10 wherein:

the plurality of conductor retainers comprises a plurality of holes and a plurality of screws, wherein one each of said plurality of screws intersects with one each of said plurality of holes, whereby a conductor is securely held in each of said plurality of holes.

16. An adjustable ground clamp that adjusts to different sizes of electrical conduits as in claim 10 wherein:

said terminal block is formed on said first jaw.

17. An adjustable ground clamp that adjusts to different sizes or diameters of electrical conduits without detachment of any parts that can be quickly and easily placed on an electrical conduit comprising:

a first jaw;

a first inside angled surface formed on said first jaw;

a first outside angled surface formed on said first jaw;

a first intermediate surface formed on said first jaw between said first inside angled surface and said first outside angled surface;

wherein an angle is formed between said first inside angled surface and said first outside angled surface of substantially one-hundred and five degrees;

a second jaw;

a second inside angled surface formed on said second jaw;

a second outside angled surface formed on said second jaw;

a second intermediate surface formed on said second jaw between said second inside angled surface and said second outside angled surface;

wherein an angle is formed between said second inside angled surface and said second outside angled surface of substantially one-hundred and five degrees;

a hinge connecting said first and second jaws together;

a first distal end of said first jaw having an elongated hole therein;

a curved fork formed on a second distal end of said second jaw, said curved fork having a radius and a slot formed therein;

a bolt having a head placed through the elongated hole in said first distal end of said first jaw and having a threaded portion adapted to fit within the slot formed in said curved fork;

a cylindrical nut having a diameter placed on the threaded portion of said bolt, the diameter of said cylindrical nut mating with the radius of said curved fork;

a stem placed on said first jaw;

a lip placed on said first jaw adjacent said stem; and a screw extending through said stem, so that a ground conductor may be positioned adjacent said stem and securely held by said lip and said screw;

a terminal block having a plurality of conductor retainers formed on said terminal block, whereby said bolt and said cylindrical nut may be removed from the curved fork and said first and second jaws pivoted open for receiving the electrical conduit and the bolt repositioned within the slot with said cylindrical nut held by said curved fork securely retaining the electrical conduit between said first and second jaws and a plurality of conductors may be held in the plurality of retainers permitting a multiple number of electrical devices to be grounded.

18. An adjustable ground clamp that adjusts to different sizes of electrical conduits as in claim 17 wherein:

the plurality of conductor retainers comprises a plurality of holes and a plurality of screws, wherein one each of said plurality of screws intersects with one each of said plurality of holes, whereby a conductor is securely held in each of said plurality of holes.

* * * * *